US006719334B1

(12) United States Patent
Curtis

(10) Patent No.: US 6,719,334 B1
(45) Date of Patent: Apr. 13, 2004

(54) DOOR LATCH ASSEMBLY FOR ROLL-UP DOORS

(76) Inventor: David B. Curtis, P.O. Box 1027, Villa Rica, GA (US) 30180

( * ) Notice: Subject to any disclaimer, the term of this patent is extended or adjusted under 35 U.S.C. 154(b) by 0 days.

(21) Appl. No.: 10/364,992

(22) Filed: Feb. 12, 2003

Related U.S. Application Data

(60) Provisional application No. 60/356,717, filed on Feb. 13, 2002.

(51) Int. Cl.[7] ..... E05C 19/08; E05B 67/00

(52) U.S. Cl. ..... 292/281; 292/148

(58) Field of Search ..... 160/201, 290.1; 292/138, 145, 148, 337, 346, DIG. 36; 70/56

(56) References Cited

U.S. PATENT DOCUMENTS 1,368,711 A * 2/1921 Foley
4,095,828 A * 6/1978 East ..... 292/148
4,214,783 A * 7/1980 Boegeman ..... 292/150
4,229,956 A * 10/1980 Thorburn ..... 70/129
4,234,220 A * 11/1980 Finch ..... 292/148
4,307,904 A * 12/1981 Daus ..... 292/148
4,437,692 A * 3/1984 Halopoff ..... 292/57
4,613,175 A * 9/1986 Nelson ..... 292/148
5,704,663 A 1/1998 Clay, Jr.

* cited by examiner

*Primary Examiner*—Gary Estremsky
(74) *Attorney, Agent, or Firm*—Jason A. Bernstein; Powell, Goldstein, Frazer & Murphy LLP

(57) ABSTRACT

A door latch generally comprising a latch cover and a latch slide. The latch cover comprises a upper angled section having a vertical portion and an angled portion extending therefrom, at least one first aperture defined in the vertical portion, at least one first slot defined in the angled portion, a horizontal portion having at least one second slot defined therein, and, at least one third slot defined therein substantially aligned with the first slot, a vertical middle section having a second aperture defined therein, and, a slide guide extending from one side, the slide guide having an upper spacer leg and, a lower spacer leg, an angled lower portion having a vertical edge, the vertical edge having at least one fourth aperture defined therein. The latch slide comprises a vertical section having a first end and a second end and an upper edge, a notch at the first end and, a tang extending from the second end, a horizontal section extending generally perpendicularly from at least a portion of the upper edge, the horizontal section having at least one fourth slot defined therein, an angled portion extending from one edge of the and, a pull tab extending from the extending angled portion such that the latch can slidingly engage the latch cover and reciprocatingly slide between a tang retracted position and a tang extended position.

1 Claim, 5 Drawing Sheets

DOOR LATCH ASSEMBLY FOR ROLL-UP DOORS

CROSS-REFERENCE TO RELATED APPLICATION

This application claims priority benefit from co-pending U.S. provisional application No. 60/356,717, filed Feb. 13, 2002, entitled DOOR LATCH ASSEMBLY FOR ROLL-UP DOORS, the disclosure of which is incorporated by reference in its entirety herein.

FIELD OF THE INVENTION

The present invention relates to door latch assemblies for roll-up doors.

BACKGROUND OF THE INVENTION

Roll-up doors are commonly used in rental storage unit facilities, commonly known as "mini-storage" places. A storage unit usually consists of a storage room with access controlled by a roll-up door. The door is secured by a lock, such as a key or combination lock with a shank, hasp or shackle which is attached to the door latch mechanism. When locked, the door latch has a tongue, pin or other object which slides to project into a space in the door frame, thus preventing access to the storage room. Many conventional door latches provide poor or minimal protection for the lock shank to avoid being cut by an intruder.

It would be desirable to have a door latch mechanism that can accept one or more lock shanks and when in a locked position minimizes the amount of shank available to be cut. Further, it would be desirable to have a door latch mechanism that was designed to minimize water, ice and snow accumulation so as to prevent the latch and lock from freezing. Additionally, it would be desirable to have a latch mechanism that was formed of stamped steel that is easily and inexpensively manufacturable.

SUMMARY OF THE INVENTION

The present invention provides, in one exemplary embodiment, a door latch generally comprising a latch cover and a latch slide. The latch cover comprises a upper angled section having a vertical portion and an angled portion extending therefrom, at least one first aperture defined in the vertical portion, at least one first slot defined in the angled portion, a horizontal portion having at least one second slot defined therein, and, at least one third slot defined therein substantially aligned with the first slot, a vertical middle section having a second aperture defined therein, and, a slide guide extending from one side, the slide guide having an upper spacer leg and, a lower spacer leg, an angled lower portion having a vertical edge, the vertical edge having at least one fourth aperture defined therein. The latch slide comprises a vertical section having a first end and a second end and an upper edge, a notch at the first end and, a tang extending from the second end, a horizontal section extending generally perpendicularly from at least a portion of the upper edge, the horizontal section having at least one fourth slot defined therein, an angled portion extending from one end and, a pull tab extending from the extending angled portion such that the latch can slidingly engage the latch cover and reciprocatingly slide between a tang retracted position and a tang extended position.

It is a feature of the present invention to provide a door latch assembly that provides a secure receptacle for a lock shank and provide minimal exposure of the shank when in position to being cut.

It is another feature of the present invention to provide a door latch assembly that minimizes the potential accumulation of water, snow and ice so as to reduce freezing of the latch mechanism.

It is yet another feature of the present invention to provide a door latch assembly that is easily and inexpensively manufacturable.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENTS

Figure 12:
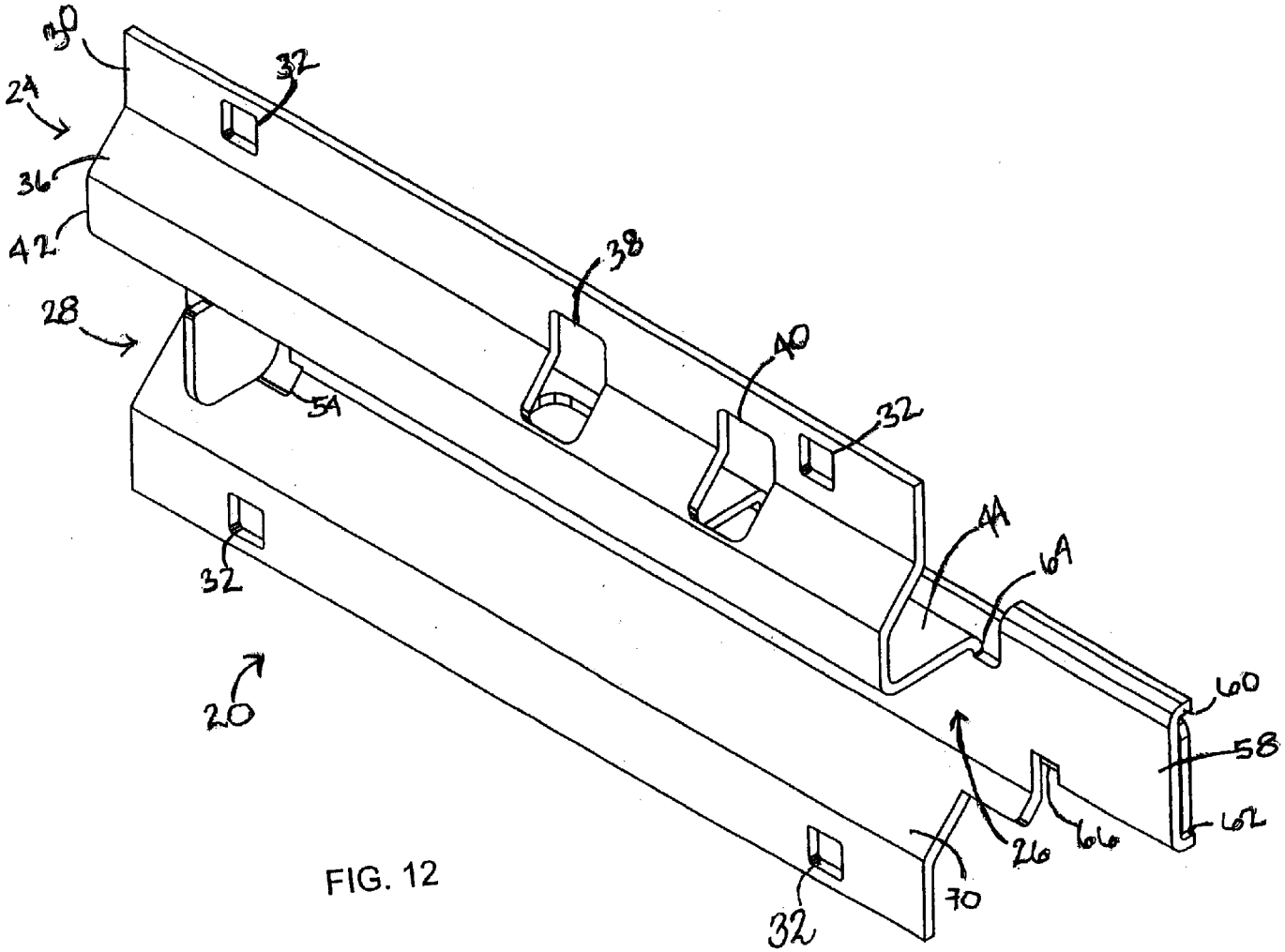
FIG. 12 is a perspective view of a door latch cover and slide shown in the unlatched or retracted position.
Figure 13:
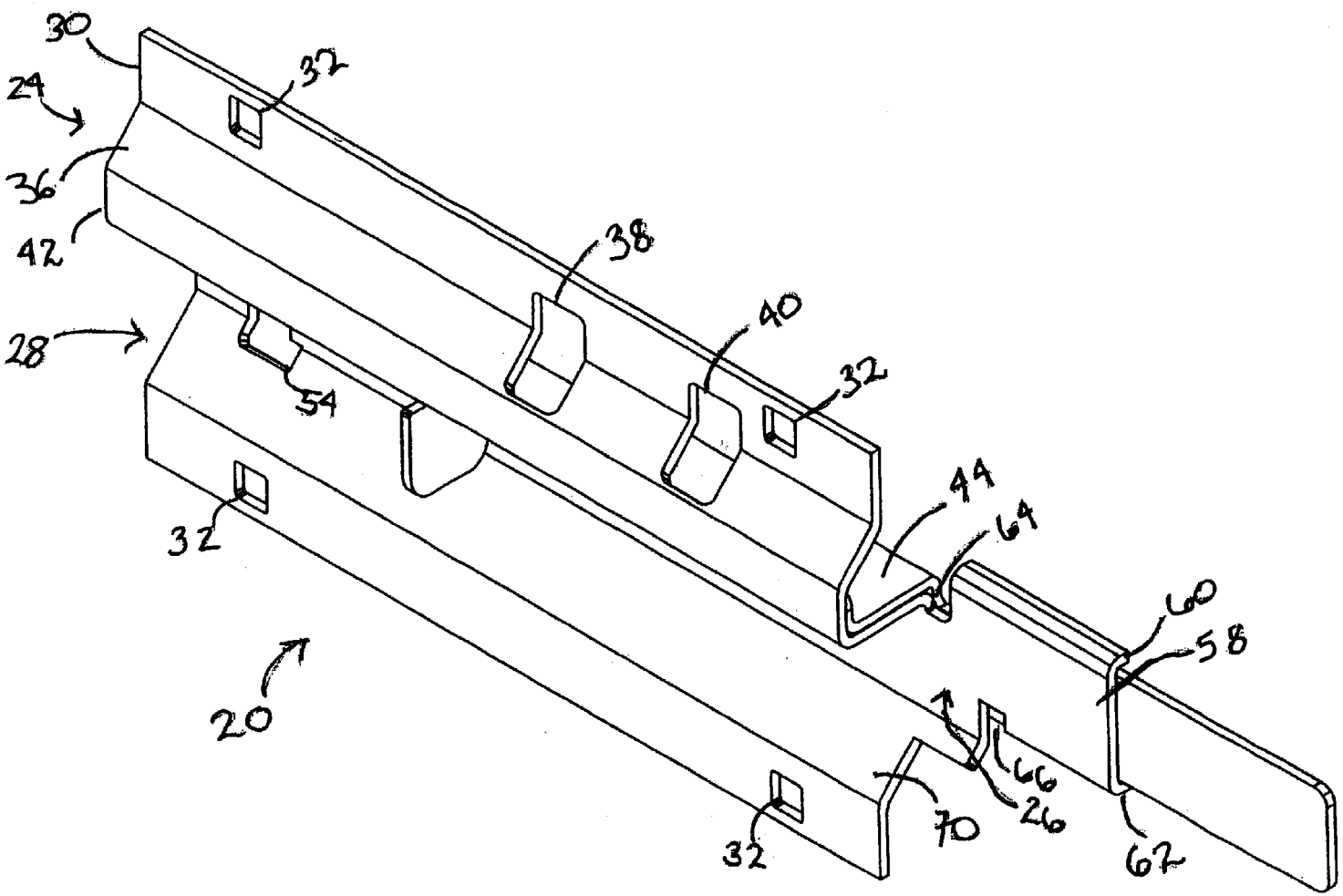
FIG. 13 is a perspective view of a door latch cover and slide shown in the latched position.

In one exemplary embodiment, the present invention provides a door latch assembly 10, comprising a latch cover 20 and a latch slide 22. FIGS. 1–7 show the door latch cover, FIGS. 8–11 show the latch slide and FIGS. 12–13 show the latch assembly.

Figure 5:
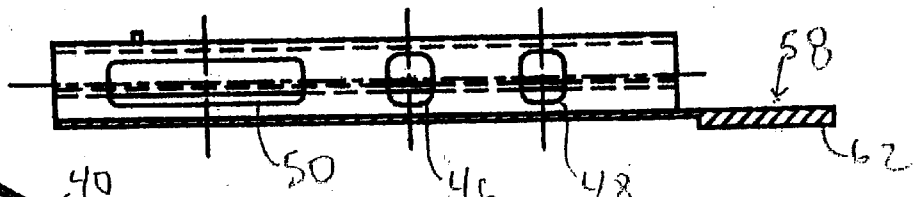
FIG. 5 is a bottom view of the latch cover of FIG. 1.

Turning to FIGS. 1–7, the latch cover 20 may be formed from stamped steel or other preferably rigid material capable of withstanding environmental exposure and attempted intrusion by force. In one exemplary embodiment, the latch cover 20 is stamped of 304 stainless steel. The latch cover 20 comprises an upper section 24, a middle section 26 and a lower section 28. The upper section 24 comprises an upper vertical portion 30 having at least one spaced apart bolt apertures 32. In one exemplary embodiment two apertures 32 are used, however a greater number could be used. Alternatively, each aperture 32 can be a slot to facilitate more precise alignment of the cover with a door curtain 34 (shown in FIG. 7). Depending from the vertical portion 30 is an angled portion 36. An aperture 38 and an aperture 40 are defined in the vertical portion 30 and angled portion 36. Preferably, the general shape of the apertures 38 and 40 are rectangular or slot-like, although other suitable regular or irregular shapes are possible. A lower vertical portion 42 depends downward from the angled portion 36. A horizontal portion 44 extends horizontally from the lower vertical portion. The upper section 24 extends beyond the lower section 28 when installed on a door curtain 34. The horizontal portion 44 has a slot 46 and a slot 48 defined therein, as shown in FIG. 5. The slots 46 and 48 are aligned with the slots 38 and 40. As described further hereinbelow, the aperture 38 and the slot 46 are aligned and sized to accommodate a conventional lock shank (not shown). Similarly, the aperture 40 and the slot 48 are aligned and sized to accommodate the shank of a lock. The angled portion 36 and the horizontal portion 44 are at such an angle and are spaced apart so that when a lock shank is inserted in the aperture/slot and locked there is minimal exposure of the lock shank to being cut. In many applications, locks have been developed to present a minimal amount of shank, which commonly is the weak point of a lock with respect to insult by a bolt cutter, saw, torch or the like. Also, the downward angle of the angled portion 36 facilitates water runoff and minimizes dirt, snow and ice accumulation.

The horizontal portion 44 also has a slot 50 defined therein which can accommodate part of the latch 22, as discussed further hereinbelow.

Figure 1:
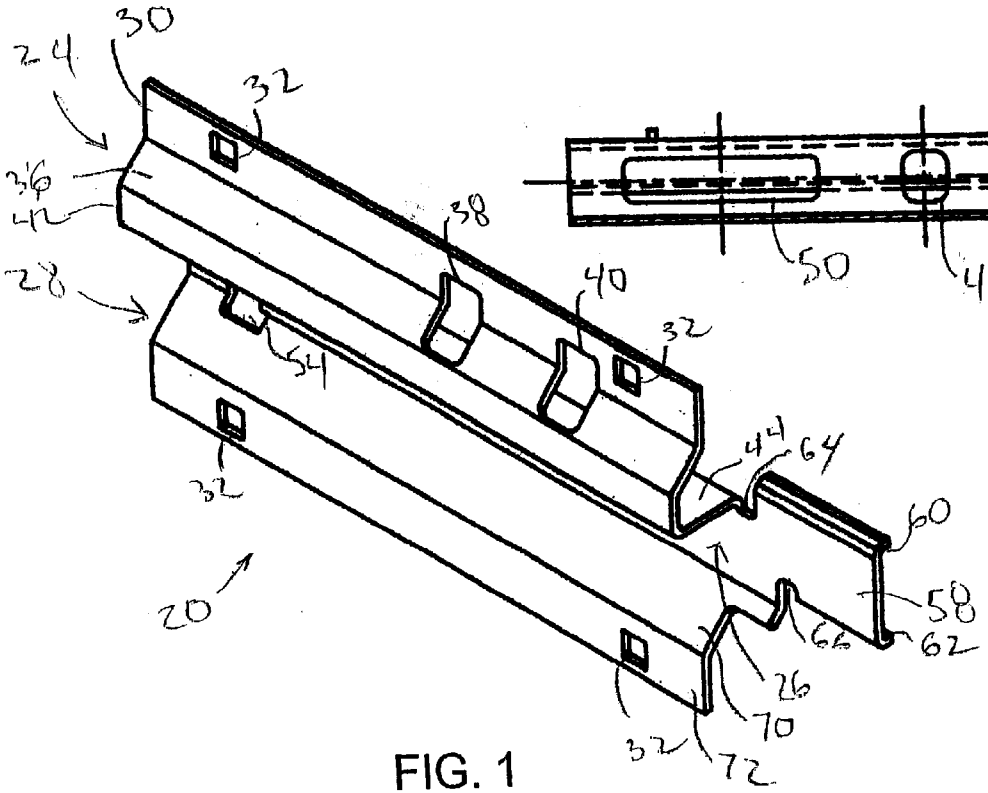
FIG. 1 is a perspective view of a door latch cover according to one exemplary embodiment of the present invention.
Figure 6:
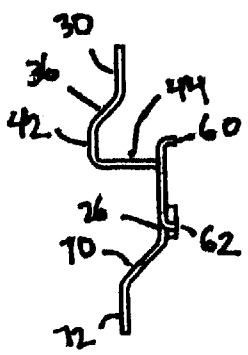
FIG. 6 is a side view of the latch cover of FIG. 1.
Figure 4:
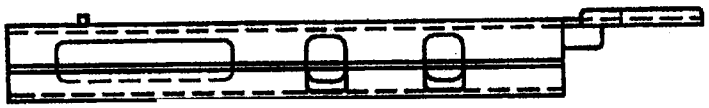
FIG. 4 is a top view of the latch cover of FIG. 1.
Figure 2:
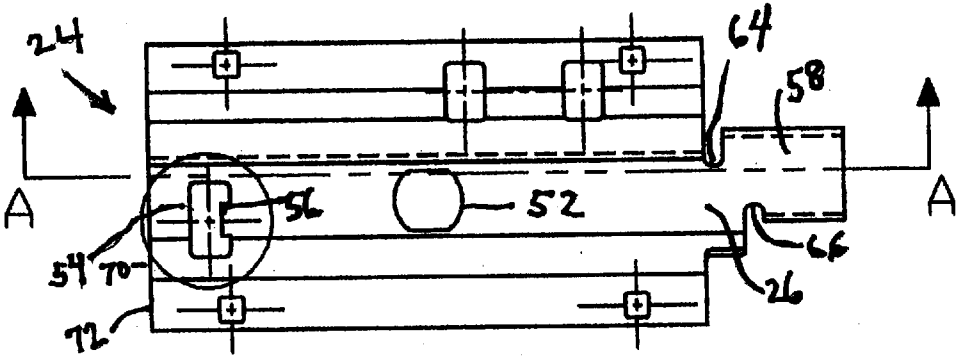
FIG. 2 is a front elevational view of the latch cover of FIG. 1.
Figure 3:
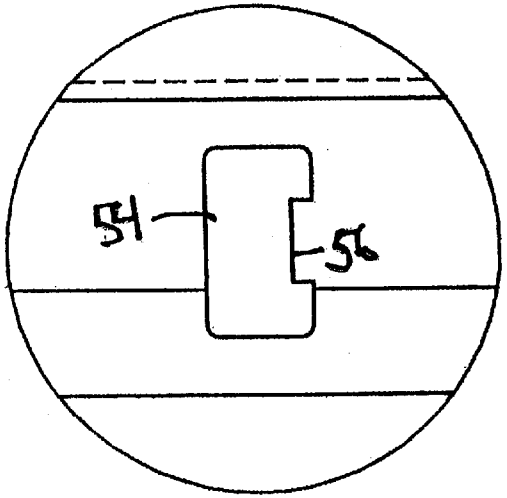
FIG. 3 is a front elevational view detail of the latch cover of FIG. 2.
Figure 8:
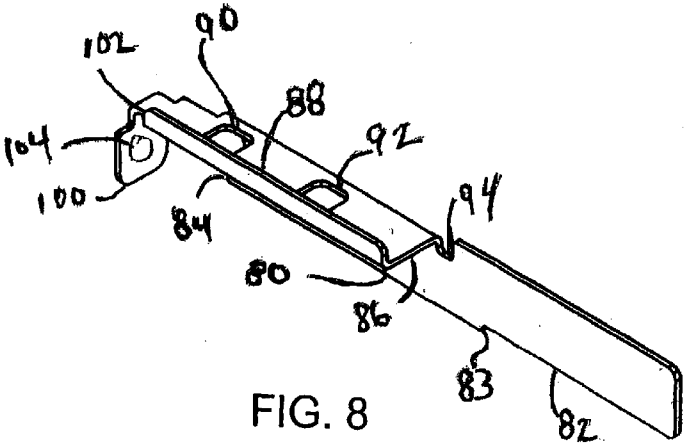
FIG. 8 is a perspective view of a latch slide according to one exemplary embodiment of the present invention.
Figure 9:
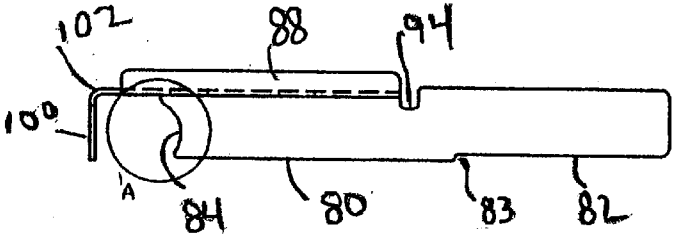
FIG. 9 is a front elevational view of the latch slide of FIG. 8.
Figure 10:
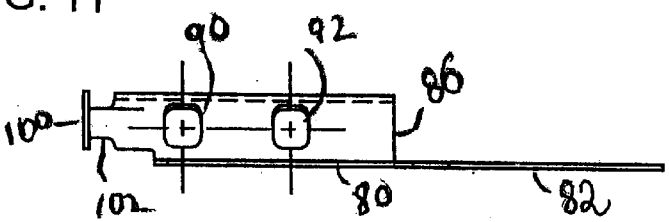
FIG. 10 is a bottom view of the latch slide of FIG. 8.
Figure 11:
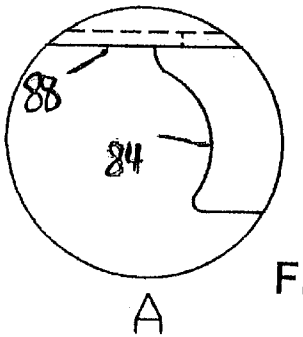
FIG. 11 is a detail of the latch slide of FIG. 9.

The middle section 26, with which the horizontal portion 44 is associated, is generally parallel to the vertical portion 42. As shown in FIG. 2, the middle section 26 preferably has an aperture 52 which can accommodate a conventional cylinder lock (not shown). Preferably, as shown in FIG. 2 and in detail in FIG. 3, there is an aperture 54 having a side tab 56 formed towards one end of the middle section 26. The side tab 56 is bent towards the back of the middle section 26. The side tab 56 acts as a spacer to permit the latch slide 22 to move more freely when installed on the door curtain 34. Alternatively, it is possible to not have the aperture 54 and instead have the tab 56 extend from the edge of the middle portion 26. Where the present invention is to be stamped from material, it is anticipated that this alternative would form a tab less strong than in the preferred aperture 54/tab 56 arrangement. A slide guide 58 extends from the other end of the middle portion 26. The slide guide 58 (shown in FIG. 1) has spacer legs 60 and 62 extending from the upper and lower edges of the guide 58 for providing a guide for the latch slide 22. Notches 64 and 66 are formed to permit easier stamping and bending of the spacer legs 60 and 62. Preferably, the notches 64 and 66 are offset from the vertical parallel to minimize material weakness at that portion. The spacer legs 60 and 62 act with the tab 56 to space the middle section 26 away from the door curtain 34 when installed to permit movement of the latch slide 22.

Figure 7:
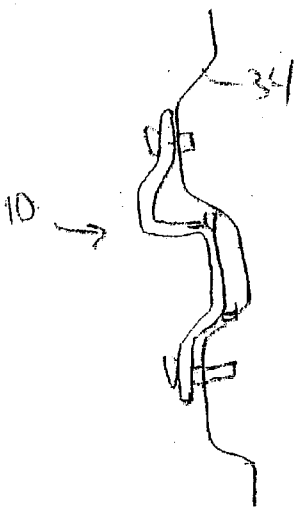
FIG. 7 is a side view of the latch cover of FIG. 1 attached to a door curtain.

The lower section 28 has an angled portion 70 depending downward from the middle portion 26. At the left side (as shown in FIG. 1) is part of the aperture 54 which extends from the middle portion 26. Depending downward from the angled portion 70 is a lower vertical portion 72, which is generally parallel with the upper vertical portion 30. At least one, and preferably a plurality of apertures 32 (or slots, as described hereinabove) are defined in the lower vertical portion 72 for accommodating a bolt or bolts. The angled portion 70 preferably conforms generally to the angle of a conventional corrugated door curtain 34, as shown in FIG. 7. The angle can be modified for different door curtain 34 angles.

FIGS. 8–11 show the latch slide 22, which comprises a vertical portion 80, extending from the right side (as shown in the drawings) of which is a tang 82. The tang 82 has a notch 83 which acts as a stop. At the left side is a notch 84, preferably curved. The notch 84 is preferably curved to generally match a portion of the curve of the aperture 52 so that when the latch slide 22 is in place and in the extended position, the cylinder lock can pass through the latch slide notch 84 and the aperture 52.

Extending horizontally from the top edge of the vertical portion 80 is a horizontal portion 86, which terminates at one side in a vertically and upwardly extending section 88. In the horizontal portion 86 is an aperture 90 and an aperture or slot 92, which are sized and positioned to align with the apertures 38 and 40 and the slots 46 and 48, when the latch slide 22 is in the extended position in the latch cover 20 (shown in FIG. 13 and described further hereinbelow). A notch 94 is formed in the upper edge of the vertical portion 80 to facilitate the punch bending the horizontal portion 86.

A pull tab 100 extends from the left side of the horizontal portion 86 by way of a right-angle section 102 (although the exact angle is not critical). The pull tab 100 preferably has a hole 104 defined therein which can accommodate a cable, wire or other implement which can be attached to a handle, ring, strap, T-bar or the like to facilitate grasping, such as by individuals with difficulties in manual dexterity.

The latch slide 22 is preferably formed of a rigid material that can withstand environmental exposure and have sufficient strength to resist attack. In a preferred embodiment, the latch slide 22 is stamped from 430 stainless steel. The latch slide 22 is preferably, though not mandatorily, capable of having magnetic properties, such as a magnet attached to a sensor in the door jamb which can detect when the latch 22 has been retracted or inserted into the jamb.

FIG. 12 shows the latch assembly 10 with the latch slide 22 in the retracted position and FIG. 13 shows the latch slide 22 in the extended position within the latch cover 20. To assemble the latch slide 22 and latch cover 20, the pull tab 100 and the right-angle portion 102 of the latch slide 22 are inserted at an angle into the slot 50 in the latch cover 20. The tang 82 will slide in the spacer legs 60 and 62 with the vertical portion 80 being parallel to the vertical portion 26. Note that the distance of extension of the tab 56 and the spacer legs 60 and 62 is preferably at least as large as the thickness of the tang 82 and vertical portion 80.

When the latch slide 22 is in the retracted position, the tang 82 resides substantially within the spacer legs 60 and 62 and the slide guide 58. When the pull tab 100 is slid to the right to extend the tang 82, the tang 82 can engage a slot in the jamb of a conventional door (not shown). When the latch 22 is so extended, the aperture 90 is aligned with the aperture 38 and the slot 46 so that a lock shank can be inserted therein. Similarly, the aperture 92 is aligned with the aperture 40 and the slot 48 so that another lock shank can be inserted therein. While most users of the latch assembly 10 of the present invention will only use a single lock, the second aperture combination is provided so that a second lock can be accommodated. Such may be useful in a storage facility where the occupant of the storage unit has not paid rent and the property manager attaches a lock to the assembly 10 to prevent the renter from accessing the storage unit until the second lock is removed.

The present invention provides several advantages of prior door latch assemblies. The present invention exposes less of the lock shank to a bolt cutter, thus reducing the likelihood of defeating the lock and gaining access to the contents of a storage unit or other room. The present invention is simple, inexpensive and readily manufacturable owing to the design lending itself to be stamped, rather than sand cast. The angled profile reduces dirt, water, snow and ice buildup. Ice buildup on horizontal surfaces on conventional latches can freeze the slide and prevent the latch slide from being moved.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

It should further be noted that any patents, applications and publications referred to herein are incorporated by reference in their entirety.

What is claimed is:

1. A door latch assembly, comprising:

a) a latch cover comprising,
  i) a upper angled section having
    a) a vertical portion and
    b) an angled portion extending therefrom,
    c) at least one first aperture defined in said vertical portion,
    d) at least one first slot defined in said angled portion,
    e) a horizontal portion having
      (1) at least one second slot defined therein, and
      (2) at least one third slot defined therein substantially aligned with said first slot,
  ii) a vertical middle section having
    a) a second aperture defined therein, and
    b) a slide guide extending from one side, said slide guide having
      (1) an upper spacer leg and
      (2) a lower spacer leg
  iii) an angled lower portion having a vertical edge, said vertical edge having at least one fourth aperture defined therein, b) a latch comprising
  i) a vertical section having a first end and a second end and an upper edge
    a) a notch at said first end and
    b) a tang extending from said second end
  ii) a horizontal section extending generally perpendicularly from at least a portion of said upper edge, said horizontal section having
    a) at least one fourth slot defined therein
    b) an angled portion extending from one end and
    c) a pull tab extending from said extending angled portion such that latch can slidingly engage said latch cover and reciprocatingly slide between a tang retracted position and a tang extended position.

* * * * *